United States Patent [19]

Schiavone

[11] 4,367,475

[45] Jan. 4, 1983

[54] LINEARLY POLARIZED R.F. RADIATING SLOT

[75] Inventor: Frank J. Schiavone, Longmont, Colo.

[73] Assignee: Ball Corporation, Muncie, Ind.

[21] Appl. No.: 89,292

[22] Filed: Oct. 30, 1979

[51] Int. Cl.[3] ..... H01Q 13/18

[52] U.S. Cl. ..... 343/767

[58] Field of Search ..... 343/700 MS, 767, 768, 343/769

[56] References Cited

U.S. PATENT DOCUMENTS

| | | | |
|---|---|---|---|
| Re. 29,296 | 7/1977 | Krutsinger | 343/700 MS |
| 2,791,769 | 5/1957 | Lindenblad | 343/769 |
| 2,810,907 | 10/1957 | Woodward | 343/767 |
| 2,812,514 | 11/1957 | Smith | 343/767 |
| 2,821,708 | 1/1958 | Blancher | 343/767 |
| 3,296,616 | 1/1967 | Kuecken | 343/767 |
| 3,530,479 | 9/1970 | Waldron | 343/767 |
| 3,594,805 | 7/1971 | Chardin | 343/787 |
| 3,653,052 | 3/1972 | Campbell | 343/708 |
| 3,701,161 | 10/1972 | Gregory | 343/767 |
| 3,823,404 | 7/1974 | Buie | 343/767 |
| 4,005,429 | 1/1977 | Ikrath et al. | 343/768 |
| 4,197,545 | 4/1980 | Favaloro et al. | 343/767 |

*Primary Examiner*—Eli Lieberman

*Attorney, Agent, or Firm*—Gilbert E. Alberding

[57] ABSTRACT

A linearly polarized r.f. radiating slot is formed by the juxtaposed but separated and unshorted edges of two electrically conducting plates disposed above a ground plane. R.f. feedline is connected proximate the slot edges and, preferably, distributed therealong so as to provide a more uniform feed. In a non-resonant embodiment, lumped reactance (preferably plural discrete devices distributed along the slot length) is connected across the slot so as to form a resonant antenna structure. Both the slot and the r.f. feedline are preferably formed by photo etching techniques commonly used for the construction of printed circuits.

24 Claims, 7 Drawing Figures

(NON-RESONANT DESIGN)

(FOLDED RESONANT DESIGN

LINEARLY POLARIZED R.F. RADIATING SLOT

This application generally relates to linearly polarized r.f. radiating slot antenna structures. In the preferred exemplary embodiment, the structures are substantially formed by photo etching techniques commonly used for constructing microstrip antennas and printed circuits.

Microstrip antennas having linearly polarized radiating slots formed between the edge of a radiator plate and an underlying ground plane are well known in the art. However, although nominally linearly polarized, these microstrip radiating slots actually also produce considerable cross polarization components in the radiated field. The degree of cross polarization experienced in the radiated field will vary as function of the spatial region examined. However, in certain arrays of microstrip radiators, such cross polarization components lead to serious field pattern degradation. Sometimes, this degradation may not even permit certain array designs to be useable.

Now, however, it has been discovered that a new single slot, linearly polarized microstrip structure produces much lower cross polarization components in the radiated field. In actual measurements made to date, cross polarization components have been more than 20 dB less than the desired linear polarization components when using this invention. Such low cross polarization will permit array pattern synthesis in situations where conventional microstrip cross polarization components would forbid such designs.

The single slot linearly polarized radiator of this invention uses an odd mode resonant or non-resonant structure whereas traditional microstrip slot radiators utilize even mode structures. In either the resonant or non-resonant embodiment, the radiating slot of this invention is formed by the juxtaposed edges of two separate electrically conducting plates or areas which lie substantially within a single plane or layer (if conformed to a curved surface or the like). The thus formed radiating slot is much narrower than conventional radiating wave guide slots or the like and is also totally unshorted at the ends of the slot, contrary to the usual wave guide slot radiator structure. In the preferred embodiment, the slot is formed by conventional photo etching techniques by selectively etching away portions of a conductive layer bonded to one side of a dielectric sheet.

The outboard edges of the plates or areas used to define the radiating slot are shorted to an underlying ground plane so as to define an included cavity therebetween. The cavity can have a resonant dimension or, if a non-resonant dimension is utilized, the structure can nevertheless be made resonant by adding an appropriate reactive impedance (e.g. a plurality of capacitors) across the radiating slot (preferably plural discrete devices distributed along the slot).

While the radiating slot of this invention may be fed simply by connecting a coaxial feedline across the slot edges, a more uniformly distributed feed is preferably utilized along the slot length. In the preferred exemplary embodiment, a corporate structured microstrip feedline is formed by photo etching techniques and disposed beneath the antenna structure. Feed through structures from the branches of the corporate feedline then pass upwardly through a dielectric layer, to connections proximate one edge of the radiating slot.

Both the feedline connections and the lumped tuning reactance (if a non-resonant design is utilized) are preferably connected as close as possible to the respective opposed edges of the radiating slot in the preferred exemplary embodiment. However, depending upon the frequency of operation, the structure will also work when such connections are made at other locations proximate these edges as should be appreciated.

These and other advantages and objects of the invention will be more completely appreciated and understood by reading the following detailed description of the presently preferred exemplary embodiments of the invention taken in conjunction with the accompanying drawings of which:

FIGS. 1 and 1*a* are an exploded perspective view and a cross-sectional view respectively of the presently preferred exemplary embodiment of this invention;

Figure 1:
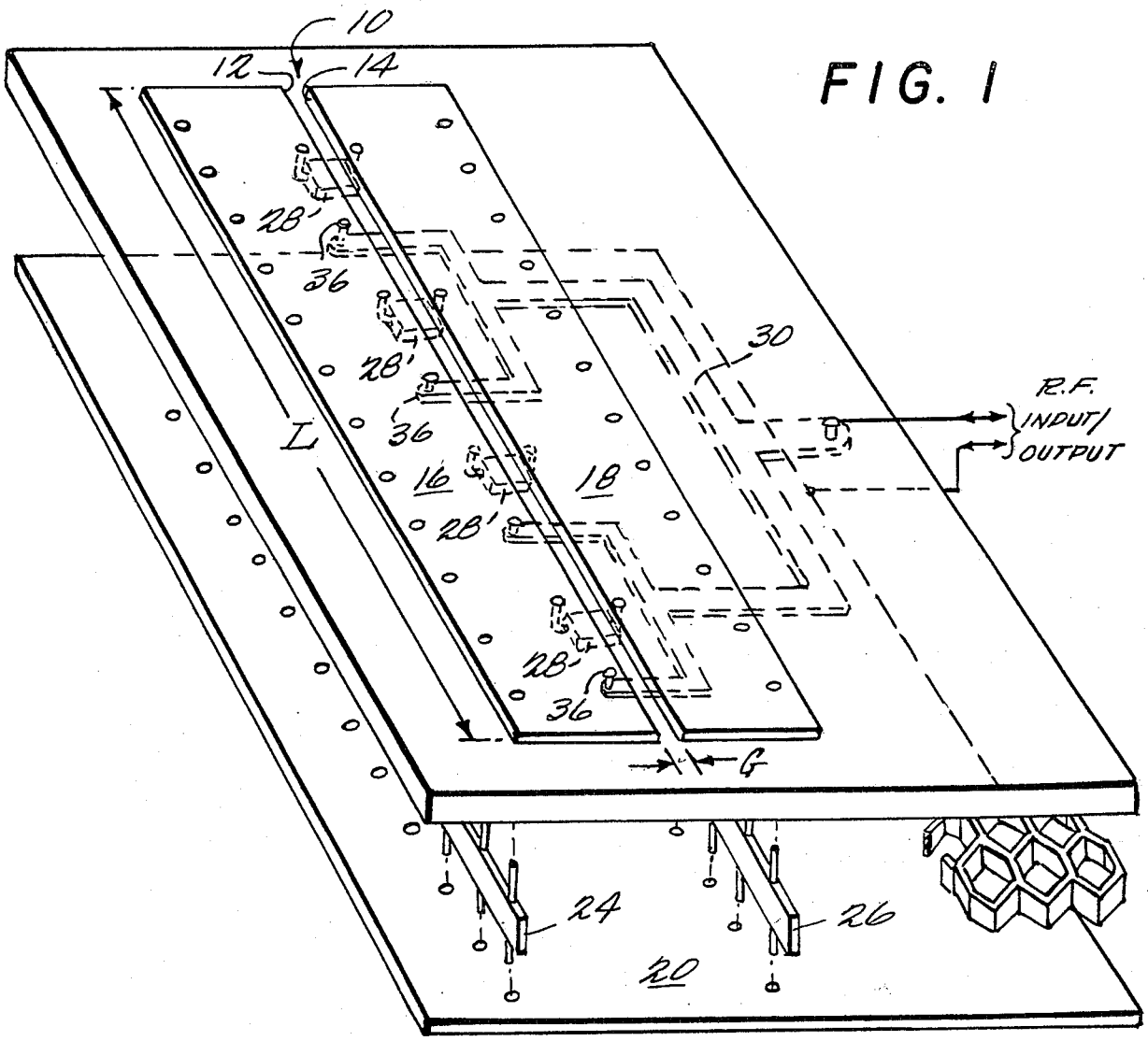
Figure 1A:
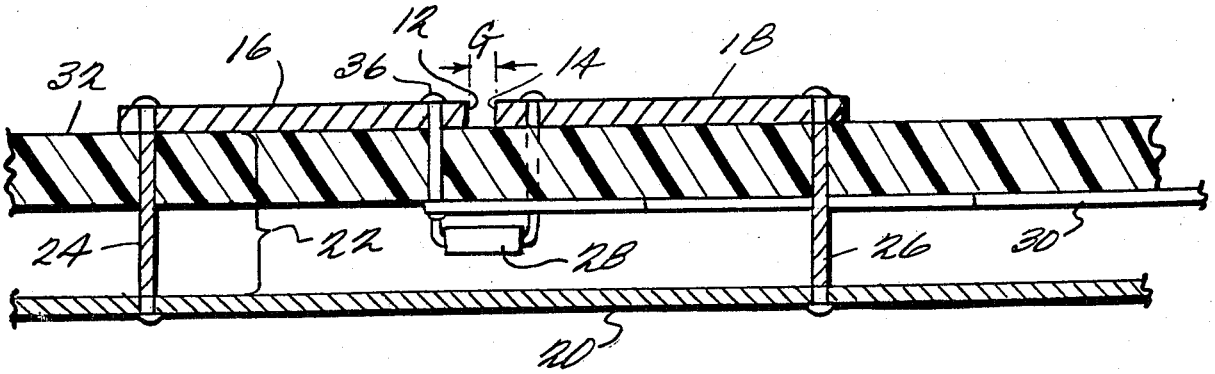

Referring to FIGS. 1 and 1*a*, a radiating slot 10 is formed by the opposed edges 12 and 14 of two separate electrically conducting plates 16 and 18 respectively. Edges 12 and 14 are juxtaposed substantially within one plane thereby defining the radiating slot 10. A conducting ground plane 20 is disposed beneath the plates 16 and 18 thus defining a cavity 22 therebetween. Cavity 22 is also defined by electrical shorts 24 and 26 extending along the length of plates 16 and 18 and connecting those plates to the underlying ground plane. As will be appreciated by those in the art, the electrical shorts 24 and 26 may comprise a series of closely spaced electrical connections through the dielectric of cavity 22 rather than a continuous connection as shown in FIG. 1.

The radiating slot 10 differs from the usual wave guide radiating slot in at least two respects. First of all, it should be noted that the ends of the plates defining the radiating slot are not electrically connected. That is, the plates 16 and 18 whose edges define the radiating slot are separate electrically conducting plates rather than being connected at the ends of the slot. Among other things, this permits the radiating slot of this invention to be fed more uniformly along its length. Secondly, the transverse slot dimension G is much narrower than the usual wave guide radiating slot which is often on the order of $\frac{1}{2}$ wavelength. In the presently preferred exemplary embodiment, the transverse slot dimension G is on the order of only 0.03 to 0.1 inch at a frequency of approximately 225 mHz.

Figure 6:
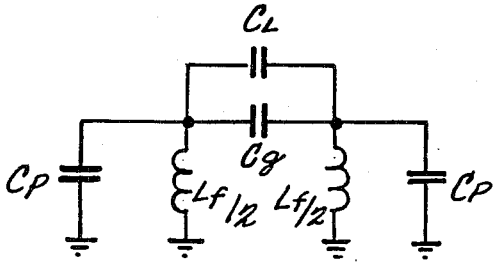
FIG. 6 is an exemplary equivalent circuit diagram of the equivalent reactive impedances presented by the antenna structures of the exemplary embodiments in FIGS. 1–3.

The cavity 22 in FIG. 1 is not self resonant. Instead, a series of discrete capacitors 28 are connected across the slot to provide a resonant antenna structure. Referring to the equivalent structure shown in FIG. 6 the parasitic capacitances $C_p$ are normally negligible and, in any event, very much smaller than the gap capacitance $C_g$. In turn, the gap capacitance $C_g$ is very much smaller than the combined capacitance of capacitors 28 which have been collectively denoted as loading capacitance $C_L$ in FIG. 6. The inductance $L_f/2$ results from the plates 16 and 18 as will be appreciated. Using the equivalent circuit of FIG. 6 normal r.f. circuit design calculations well known to antenna engineers, it is possible to calculate the required loading capacitance for resonance at a particular frequency with any particular structure.

It may be observed that by making the transverse gap dimension G extremely small, the gap capacitance $C_g$ may become quite large and the structure could in fact be made to resonant without the external lumped capacitances 28. However, when the gap capacitance is made this large, it is difficult to control the manufacturing tolerances sufficiently to accurately tune the structure. Accordingly, the transverse slot dimension G is preferably made large enough to prevent the gap capacitance $C_g$ from dominating in the tuned equivalent circuit shown in FIG. 6. On the other hand, the transverse slot dimension G cannot be made too wide or the parasitic capacitance $C_p$ will dominate and it may be impossible to properly excite the structure to radiate fields as desired.

Figure 3:
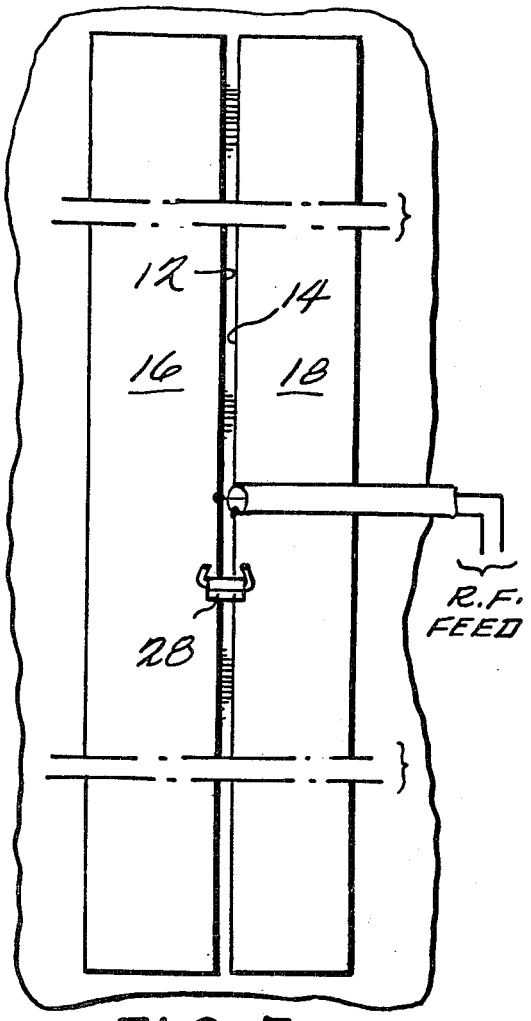
FIGS. 2 and 3 are elevation and plan views respectively of another exemplary embodiment of this invention.
Figure 2:
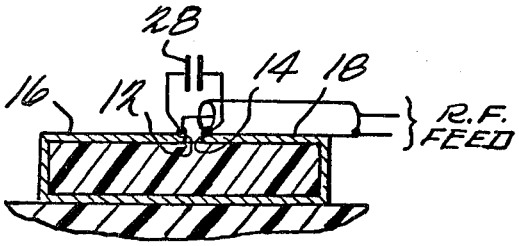

The non-resonant embodiment of FIG. 1 is also depicted in FIGS. 2 and 3 with a simple coaxial feedline having its outer conductor connected to edge 14 and its inner conductor connected to edge 12 at somewhere near the midpoint of the radiating slot. In the embodiment of FIGS. 2 and 3, the lumped capacitance 28 is simplified to a single capacitor.

However, in the preferred exemplary embodiment of FIG. 1, the lumped capacitance has been distributed in the form of several discrete capacitors 28 along the length of the radiating slot 10. Further, the r.f. feed to the slot has been similarly distributed along the length of the slot to provide a more uniform exitation of the slot. In the embodiment of FIG. 1, this feed is provided by corporate structured microstrip feedline 30 which is bonded to the underside of another dielectric layer 32. The branches 34 of the corporate structured microstrip feedline 30 are interconnected with edge 12 of the radiating slot by conductors 36 which pass through passages formed in the dielectric layer 32, and in the shorting strip 26. The r.f. feed input/output is connected as schematically shown in FIG. 1 to feed the microstrip feedline 30 with respect to the ground plane 20.

In one actually tested non-resonant embodiment of this invention, plates 16 and 18 were approximately 1 inch by 12 inches in dimension and the transverse slot dimension G was approximately 0.05 inch. The structure was caused to resonant at approximately 225 Mhz by the provision of eight 45–50 picofarad capacitors 28. Cavity 22 was approximately ¼ inch in height and incuded a honeycomb dielectric spacer material so as to provide a minimum dielectric constant. However, teflon or other dielectric materials (including a vacuum) could be utilized if desired and as will be appreciated. In this actually tested exemplary embodiment, the gap capacitance $C_g$ was probably less than one picofarad and measured cross polarization components in the radiated field were everywhere more than twenty dBs below the desired linearly polarized components. The desired linear polarization of the radiated electric fields is directed transverse to the radiating slot as should be appreciated.

The length dimension L of the radiated slot is normally dictated by size constraints or by desired design radiation resistance values as should also be appreciated by those skilled in the art.

In the preferred exemplary embodiments, the connections made to the edges 12 and 14 were formed by soldering or by rivets connected as close to the edges as possible. However, especially at lower frequencies, these connections may be made elsewhere in the vicinity of edges 12 and 14 as will be appreciated.

Figure 5:
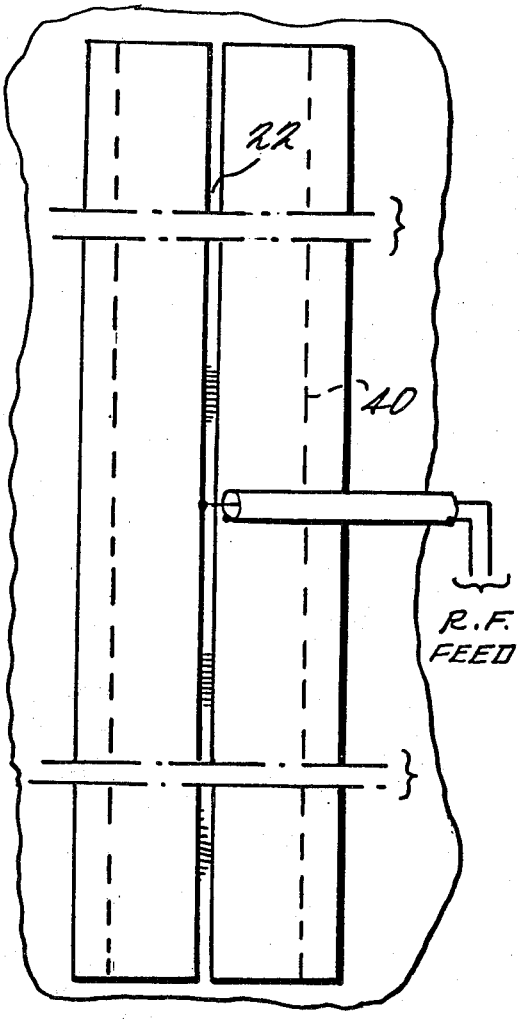
FIGS. 4 and 5 are elevation and plan views respectively of yet another exemplary embodiment of this invention.
Figure 4:
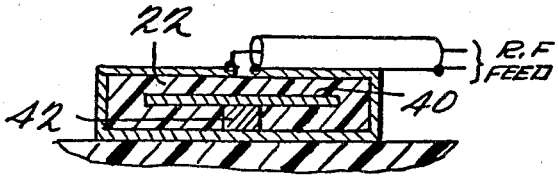

The resonant cavity design shown in FIGS. 4 and 5 is substantially identical to the embodiments of FIGS. 1–3 except that loading capacitors 28 are unnecessary because the cavity 22 is of a resonant dimension. For example, in the embodiment of FIGS. 4 and 5, the resonant cavity 22 includes a folded resonant shorted cavity having a one-fourth wavelength dimension as measured through the dielectric of the cavity from the slot around intermediate conducting plate 40 to the internal short 42. Such folded resonant cavities, per se, are also known in the art from, for example, U.S. Pat. Nos. 4,131,893 and 4,131,892 commonly assigned with this pending application.

In the preferred embodiment of this invention, the radiating slot is formed from opposed conductive edges by selectively etching away a portion of a first integral electrically conducting layer bonded to the first side of a dielectric sheet. Furthermore, in the presently preferred embodiment, r.f. electromagnetic signals are fed to/from the radiating slot by a corporate structured microstrip feedline which is also formed by selectively etching a second integral electrically conducting layer bonded to the second side of the dielectric sheet. The whole etched structure, in turn, is selectively connected to a conductive ground plane layer by suitable cavity-defining electrical shorts. Suitable feed through electrical connections are made through this layered structure to complete the antenna. Accordingly, this invention is believed to include the method of manufacturing such a structure as well as a method of transmitting or receiving linearly polarized r.f. signals by forming such a structure.

While only a few presently preferred exemplary embodiments of this invention have been specifically described in detail above, those ordinarily skilled in the art will appreciate that many modifications and variations in these exemplary embodiments may be made without departing materially from the novel and advantageous features of this invention. Accordingly, all such modifications and variations are intended to be included within the scope of the following claims.

What is claimed is:

1. A linearly polarized r.f. radiating slot antenna structure comprising:

two separate electrically conducting coplanar generally rectangular plates formed as respective islands of metal etched from a common metal sheet and disposed on a dielectric sheet in a spaced apart relationship, said plates having respective first edges juxtaposed substantially within one plane and thereby defining said radiating slot, an electrically conducting ground plane disposed beneath said two plates and electrically connected to respective second edges of said plates by a plurality of separately formed metallic connections extending from said ground plane to said second edges of said plates, each said second edge being opposite its corresponding first edge in said one plane, thus defining an electrical cavity between said plates and said ground plane, and r.f. feed means connected to at least a first one of said two plates.

2. An antenna structure as in claim 1 further comprising:

at least one lumped reactive device connected across said slot between said two plates and having a reactive impedance which causes said antenna structure to resonant at the intended r.f. frequency of operation.

3. An antenna structure as in claim 2 comprising a plurality of said lumped reactive devices spaced apart from one another and connected across said slot between said two plates and having a combined reactive impedance which causes said antenna structure to resonant at the intended r.f. frequency of operation.

4. An antenna structure as in claim 2 or 3 wherein said reactive device is a capacitor.

5. An antenna structure as in claim 1 wherein at least one dimension of said cavity is resonant at the intended r.f. frequency of operation.

6. An antenna structure as in any of claims 1, 2, 3, or 5 wherein said r.f. feed means comprises a coaxial cable having an inner conductor connected proximate an edge of one of said two plates.

7. An antenna structure as in any of claims 1, 2, 3, or 5 wherein:

said r.f. feed means comprises a microstrip feed line spaced from the underlying surface of said ground plane by a dielectric material and connected proximate the edge of said first one of said two plates for feeding r.f. signals, with respect to said ground plane, thereto or therefrom.

8. An antenna structure as in claim 7 wherein said microstrip feedline has a corporate structure with branches spaced apart along said slot and connected proximate said first plate at respectively corresponding spaced apart locations.

9. An antenna structure as in claim 8 wherein said microstrip feedline is disposed between said ground plane and said plates.

10. A linearly polarized, r.f. radiating slot antenna structure comprising:

two separated islands of metal disposed on a dielectric sheet defining a radiating slot with open non-shorted slot ends and having separated opposed conductive linear edges formed by selectively etching away a portion of an integral electrically conductive layer bonded to a first side of the dielectric sheet, a ground plane underlying said radiating slot and a plurality of metal electrical connections between the ground plane and an array of linear points on each of said islands remote from said radiating slot defining a cavity between said plural connections, said ground plane and said islands, and an r.f. feedline having at least one conductive member respectively connected proximate the middle portion of at least one of the thusly formed edges of said radiating slot.

11. An antenna structure as in claim 10 further comprising:

at least one lumped reactive device connected across said slot between said edges and having a reactive impedance which causes said antenna structure to resonate at the intended r.f. frequency of operation.

12. An antenna structure as in claim 11 comprising a plurality of said lumped reactive devices spaced apart from one another, connected across said slot and having a combined reactive impedance which causes said antenna structure to resonate at the intended r.f. operating frequency.

13. An antenna structure as in claim 11 or 12 wherein said reactive device is a capacitor.

14. A linearly polarized r.f. radiating slot antenna structure comprising:

a radiating slot with open non-shorted slot ends and having separated opposed conductive edges formed by selectively etching away a portion of an integral electrically conductive layer bonded to the first side of a dielectric sheet so as to form plural isolated coplanar islands of metal, a conductive ground plane underlying said radiating slot and defining an included cavity therebetween with plural electrical connections extending from said ground plane through said dielectric sheet to each of said islands of metal but only at points remote from said radiating slot, and an r.f. feedline having at least one conductive member respectively connected proximate the middle portion of at least one of the thusly formed edges of said radiating slot, said conductive ground plane being disposed opposite the other side of said dielectric sheet and electrically connected to said layer by said plural electrical connections to define said included cavity having at least one resonant dimension at the intended r.f. operating frequency.

15. An antenna structure as in claim 14 wherein said r.f. feedline comprises a coaxial cable having an inner conductor connected proximate one of said edges.

16. An antenna structure as in claim 14 wherein:

said r.f. feedline comprises a microstrip feedline spaced from the surface of said ground plane by a second dielectric material and connected proximate a first one of said edges for feeding r.f. signals, with respect to said ground plane, thereto or therefrom.

17. An antenna structure as in claim 16 wherein said microstrip feedline has a corporate structure with branches spaced apart along said slot and connected proximate said first edge at respectively corresponding spaced apart locations.

18. An antenna structure as in claim 17 wherein said microstrip feedline is disposed between said ground plane and said plates.

19. A method of transmitting or receiving linearly polarized r.f. electromagnetic signals, said method comprising the steps of:

forming a radiating slot with open non-shorted ends by selectively etching away a portion of an electrically conductive layer bonded to one side of a dielectric sheet so as to form islands of metal comprising two separate electrically conducting coplanar generally rectangular metallic plates having respective edges juxtaposed substantially within one plane and thereby defining said radiating slot, said plates being disposed above a ground plane and electrically connected thereto only at plural points along a line generally parallel to but remote from the juxtaposed plate edges forming said radiating slot so as to form an electrical cavity therebetween, and feeding electrical r.f. signals to/from at least one connection made across said slot and proximate the middle portion of at least one of said edges which form the radiating slot.

20. A method as in claim 19 wherein said feeding step comprises:

forming a corporate-structured microstrip feedline by selectively etching a second integral electrically conductive layer bonded to a dielectric sheet, said first and second layers being spaced from a third conductive ground plane layer, connecting the branches of said microstrip feedline through formed passages in a dielectric sheet to said first conductive layer proximate one of said edges.

21. A method as in claim 19 or 20 further comprising the step of connecting at least one capacitor across said slot proximate said edges.

22. A method of manufacturing a linearly polarized r.f. radiating slot antenna, said method comprising the steps of:

selectively etching a first conductive layer bonded to the top of a dielectric sheet to form a radiating slot with open non-shorted ends and having opposed conductive edges, selectively etching a second conductive layer bonded to the bottom of said dielectric sheet to form a corporate-structured feedline conductor, providing a third conductive ground plane layer spaced below said dielectric sheet, said corporate-structured feedline having branches spaced apart below and along said slot, and connecting said branches through passages formed in said dielectric sheet to said first conductive layer proximate the middle portion of one of said edges.

23. A method as in claim 22 further comprising the step of connecting at least one capacitor across said slot proximate said edges.

24. A linearly polarized r.f. radiating slot antenna structure comprising:

a five layered structure having two layers of dielectric material sandwiched between three layers of electrically conductive material, one conductive layer being on top, one conductive layer being on the bottom and one conductive layer being interposed in the middle of said five layered structure;

said top conductive layer being selectively etched away to define separate conductive areas having juxtaposed edges which define an r.f. radiating slot with open non-shorted ends;

said middle conductive layer being selectively etched away to define a corporate structure r.f. feedline; and feed through electrical connectors connecting said top and bottom conductive layers to form a cavity and connecting said middle conductive layer to said top conductive layer for feeding r.f. signals to/from the middle portion of at least one of said edges in said top conductive layer.

* * * * *